US007013783B2

(12) United States Patent
Matsuoka

(10) Patent No.: US 7,013,783 B2
(45) Date of Patent: Mar. 21, 2006

(54) SLIDE CAM DIE

(75) Inventor: Mitsuo Matsuoka, Osaka (JP)

(73) Assignee: Umix Co., LTD, Osaka (JP)

( * ) Notice: Subject to any disclaimer, the term of this patent is extended or adjusted under 35 U.S.C. 154(b) by 0 days.

(21) Appl. No.: 10/409,474

(22) Filed: Apr. 9, 2003

(65) Prior Publication Data

US 2003/0213351 A1 Nov. 20, 2003

(30) Foreign Application Priority Data

May 16, 2002 (JP) ..... 2002-141639

(51) Int. Cl.
*B26D 5/08* (2006.01)

(52) U.S. Cl. ..... 83/588; 83/638; 100/291; 721/452.9

(58) Field of Classification Search ..... 83/588, 83/620, 635, 638, 17–21, 376, 454, 555; 100/291; 72/312, 315, 412, 452.9, 433, 434, 72/481.1; 74/110, 567

See application file for complete search history.

(56) References Cited

U.S. PATENT DOCUMENTS 4,802,393 A 2/1989 Gruchalski et al.
5,101,705 A 4/1992 Matsuoka
5,231,907 A 8/1993 Matsuoka
5,460,027 A * 10/1995 Takahashi ..... 72/482.91
5,711,180 A * 1/1998 Sasahara et al. ..... 72/381
5,881,599 A * 3/1999 Sasahara et al. ..... 74/110
5,931,074 A * 8/1999 Matsuoka ..... 83/588
6,220,137 B1 * 4/2001 Matsuoka ..... 83/627
6,250,177 B1 * 6/2001 Sasahara ..... 74/567
6,336,399 B1 * 1/2002 Matsuoka ..... 100/266
6,619,095 B1 * 9/2003 Matsuoka ..... 72/315

* cited by examiner

*Primary Examiner*—Allan N. Shoap
*Assistant Examiner*—Phong Nguyen
(74) *Attorney, Agent, or Firm*—Birch, Stewart, Kolasci & Birch, LLP

(57) ABSTRACT

A slide cam die including a slide cam base, a wedge-shaped slide cam sliding on a guide surface of the slide cam base and mounting a press tool such as a punch or a trimming blade thereon, and an actuating cam driving the slide cam in contact therewith. A press tool is mounted on the slide cam with an adapter plate interposed therebetween. With this configuration, when a pierce punch, or a flange block, or the like, needs to be removed for reasons such as the adjustment, the pierce punch or the flange block can be individually demounted without removing the entire slide cam. This results in reduced working time. In addition, since only the adapter plate is replaced, cost savings can be achieved by reusing the slide cam. Furthermore, a given slide cam can be used while still maintaining flexibility in design and use of the slide cam die.

19 Claims, 5 Drawing Sheets

SLIDE CAM DIE

The present application claims priority under 35 U.S.C. §119 to Japanese Patent Application No. 2002-141639 filed on May 16, 2002, the entire contents of which are hereby incorporated by reference.

BACKGROUND OF THE INVENTION

1. Field of the Invention

The present invention relates to a slide cam die for fabricating a metal thin plate with a press machine.

2. Description of Background Art

Typically, a slide cam die includes a slide cam base, a wedge-shaped slide cam sliding on a guide surface of the slide cam base and mounting a press tool such as a punch or a trimming blade thereon, and an actuating cam driving the slide cam in contact therewith. With this configuration, however, a pierce punch, a flange block, or the like, mounted on the slide cam cannot by individually demounted therefrom, when a need arises, such as the need for adjusting there parts. Instead, the slide cam mounting the pierce punch, the flange block, and the like, must be removed as a whole.

When it is necessary to remove a pierce punch, a flange block for reasons such as adjustment, it would be desirable to be able to individually remove the pierce punch, the flange block, or the like, without the need to take out the entire slide cam. This would reduce a working time. In addition, if parts can be removed individually, for example, only an adapter plate might be replaced, thereby enabling the reuse of a slide cam, and thus reducing cost. Furthermore, with individually removable parts, increased design flexibility can be attained with a given slide cam. Thus, a wide variety of work pieces can be accommodated without the effort and expense of changing the slide cam.

SUMMARY AND OBJECT OF THE INVENTION

Accordingly, in light of the above circumstances, the present invention has achieved the following: When a pierce punch, a flange block, or the like, must be demounted for reasons such as adjustment, the pierce punch, the flange block, or the like, they may be individually demounted without taking out the entire slide cam. This reduces working time and effort. In addition, for example, when only an adapter plate is replaced, it is possible to reuse of a slide cam, thus achieving a reduction in cost. The components of a slide cam die include a slide cam base, a wedge-shaped slide cam sliding on a guide surface of the slide cam base and mounting a press tool such as a punch or a trimming blade thereon, and an actuating cam driving the slide cam in contact therewith, wherein a press tool is mounted on the slide cam with an adapter plate interposing therebetween. With individually removable components, the slide cam die can be made with increased design and working flexibility.

Moreover, the present invention is configured with a lock plate mounted on the slide cam to engage with an end portion of the adapter plate to position the adapter plate correctly.

Furthermore, the present invention the adapter plate is formed so as to have a section of an L-shape, and positioned by putting an inner face thereof into contact with the slide cam.

Still furthermore in the present invention, the slide cam may be either a lower die or an upper die.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENTS

Figure 1:
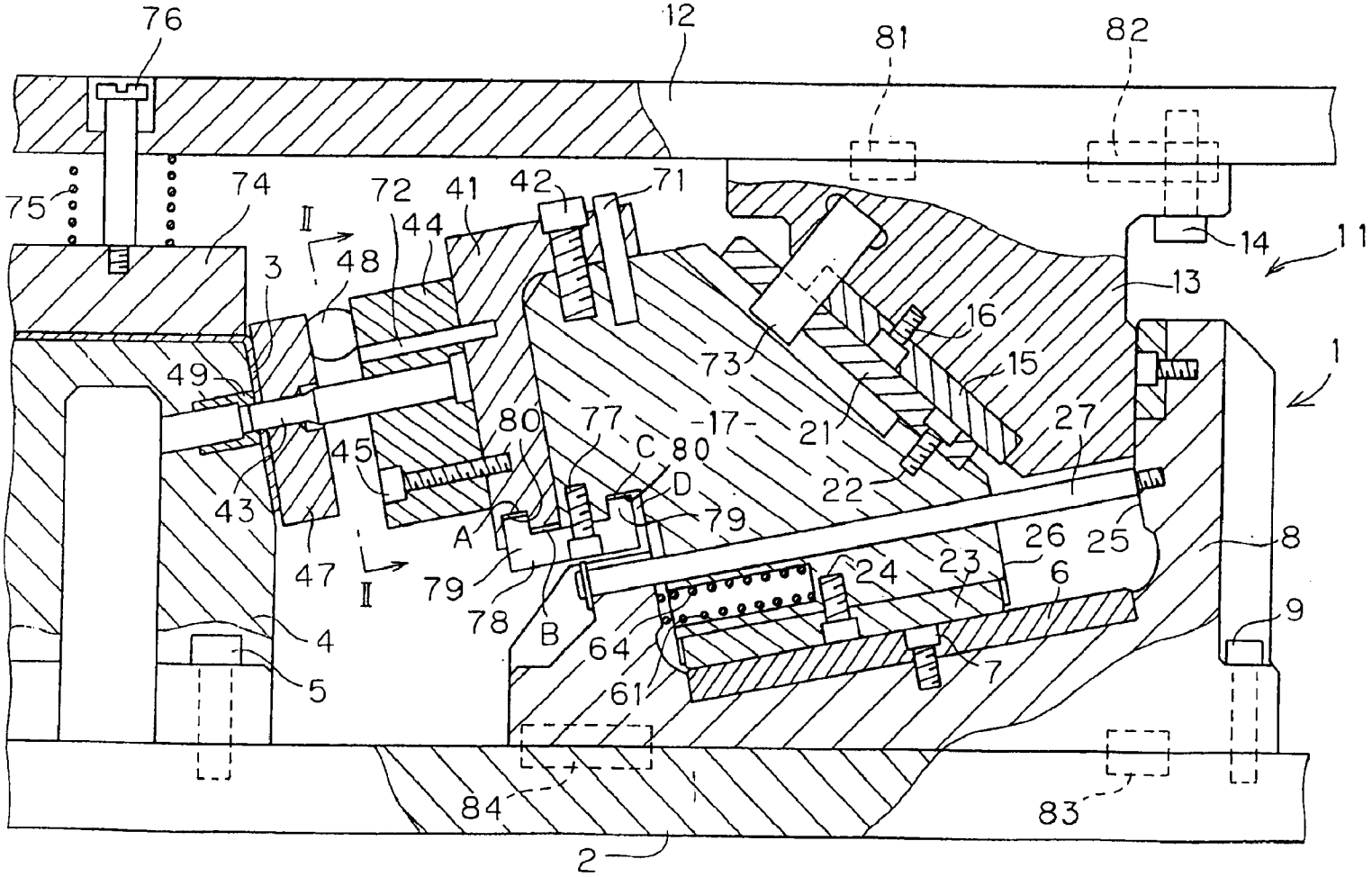
FIG. 1 is a longitudinal sectional view at the lower dead point of a slide cam die of the present invention.
Figure 2:
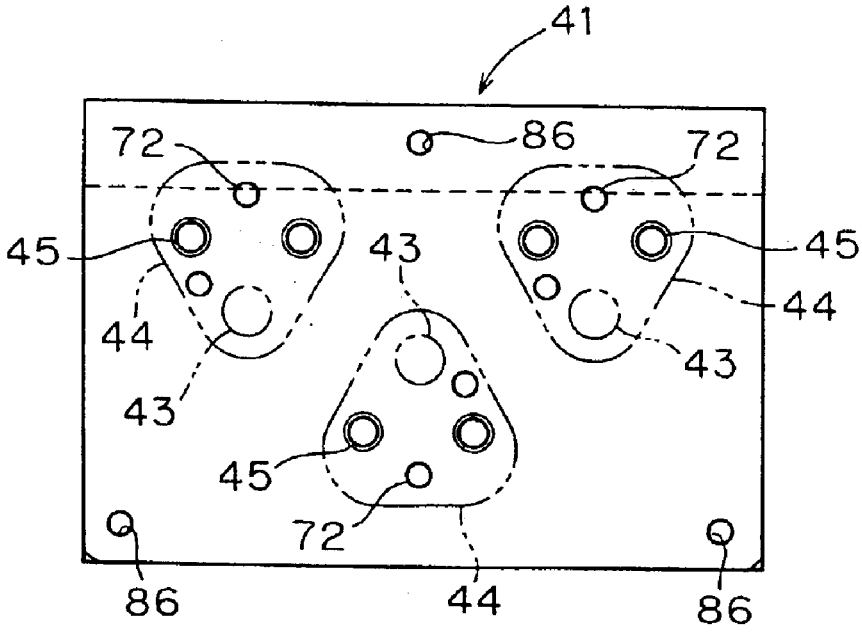
FIG. 2 is a view taken in the direction of arrows from line II—II of FIG. 1.
Figure 3:
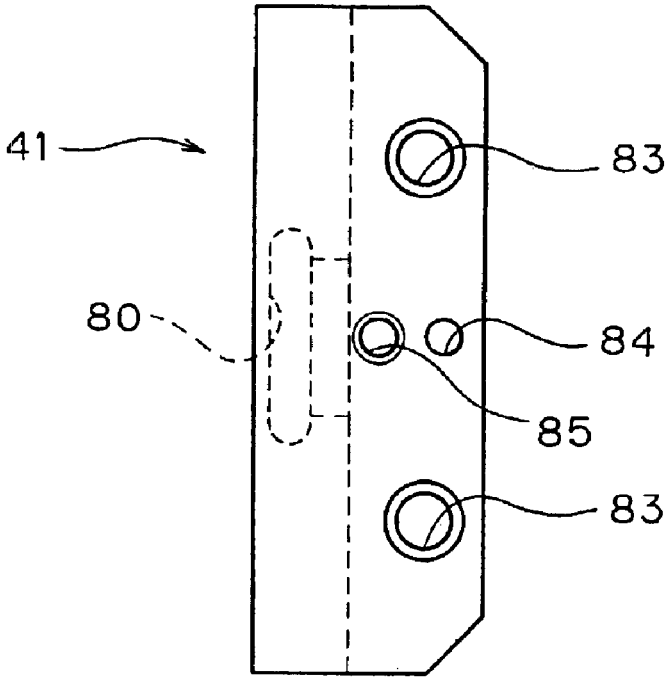
FIG. 3 is a plan view of an adapter plate of the present invention.
Figure 4:
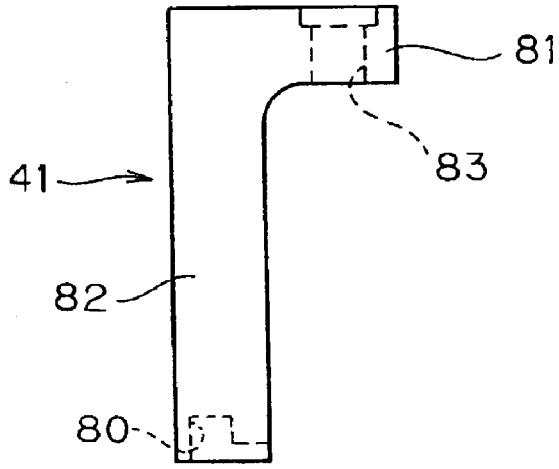
FIG. 4 is a side view of the adapter plate of the present invention.
Figure 5:
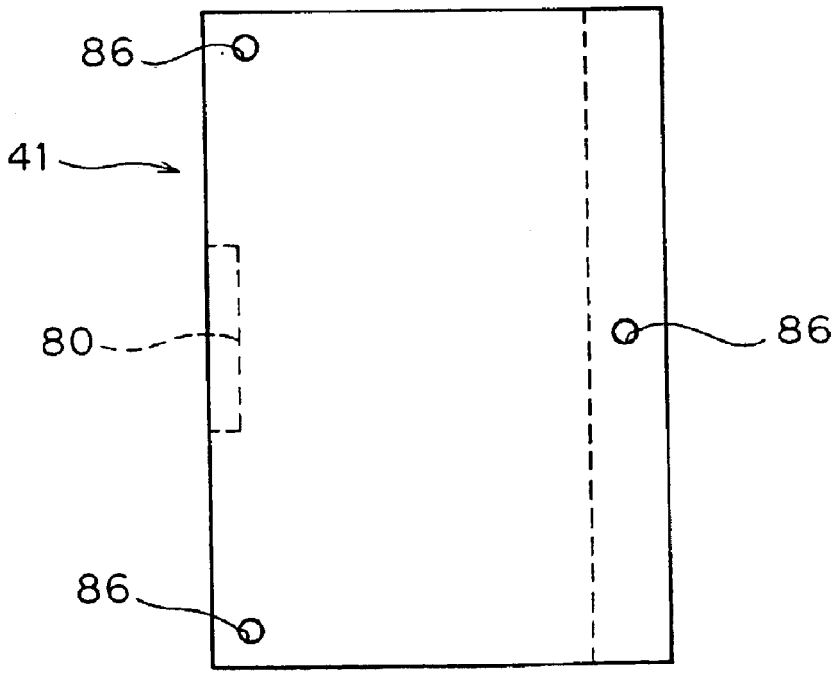
FIG. 5 is a front view of the adapter plate of the present invention.

Hereinafter, the present invention will be explained in detail on the basis of the embodiment shown in the accompanying drawings.

An example described in the present embodiment is described about an example to make a hole in a work.

A positioning member 4 to position a work piece 3 is fixed on a base plate 2 of a lower die I with a bolt 5. In the neighborhood of the positioning member 4, a slide cam base 8 mounting a wear plate 6 having an upper face inclining downwardly toward the positioning member 4 with bolt 7 is fixed to the base plate 2 with a bolt 9.

An actuating cam 13 is fixed to a base plate 12 of an upper die 11, facing the slide cam base 8, with a bolt 14. At the distal end of the actuating cam 13, a wear plate 15 is fixed with bolt 16 on a face inclining upwardly toward the positioning member 4, symmetrically with an inclined face of the slide cam base 8.

A slide cam 17 in the shape of a wedge is provided, which freely slides on the wear plate 15 of the actuating cam 13 and slides on the wear plate 6 of the slide cam base 8.

The slide cam 17 is the shape of a wedge, a wear plate 21 is fixed to an upper inclined face thereof with a bolt 22, a wear plate 23 is fixed to a lower inclined face thereof with a bolt 24, and the wear plates 21 and 23 slide, respectively, on the wear plate 15 of the actuating cam 13 and on the wear plate 6 of the slide cam base 8 in contact with them.

On the work processing side at the upper front end formed on the square of the slide cam 17, an adapter plate 41 is mounted thereto with a bolt 42 and positioned with a knock pin 71, and protruding pieces 79 of a lock plate 78 fixedly attached to the slide cam 17 below the upper front end thereof with bolts 77 are engaged in a positioning groove 80 at the lower part of the adapter plate 41. A pierce punch 43 is erected in a punch retainer 44 and the punch retainer 44 is screwed on the adapter plate 41 with a bolt 45 and positioned with a knock pin 72.

A stripper plate 47 is pressed by a cushion rubber 48 to press the work piece 3 prior to make a hole in the work piece 3.

Die 49 makes a hole by fittingly mating with the pierce punch 43.

In order to retreat the slide cam 17 after making a hole, a retaining hole 61 is formed in the lower front part of the slide cam 17, and an elastic member such as a coil spring 64 or the like, is provided in a contracted form between the retaining hole 64 and the slide cam base 8. When the upper die 11 rises, the slide cam 17 withdraws by a press force of the coil spring 64. In order to stop the withdrawal of the slide cam, an erected stopper surface 25 is formed on the slide cam base 8, and is put into contact with a rear end face 26 of the slide cam 17. A guide rode 27, attached to the slide cam base 8 and penetrating the slide cam 17, guides movement of the slide cam 17.

Furthermore, when the upper die rises, a return plate 73 is fixedly mounted into the actuating cam 13, and the lower end of the return plate 73 is engaged with the slide cam 17 in order to forcibly retreat the slide cam 17.

In the upper die 11, a pad 74 is suspended from the base plate 12 with a suspension bolt 76 under a press by a coil spring 75.

Actuating cam 13 includes positioning keys 81, 82, and slide base cam 8 includes positioning keys 83, 84.

Next, actuation of the metal die will be described. The state shown in FIG. 9 is the upper dead point of the metal die.

Figure 9:
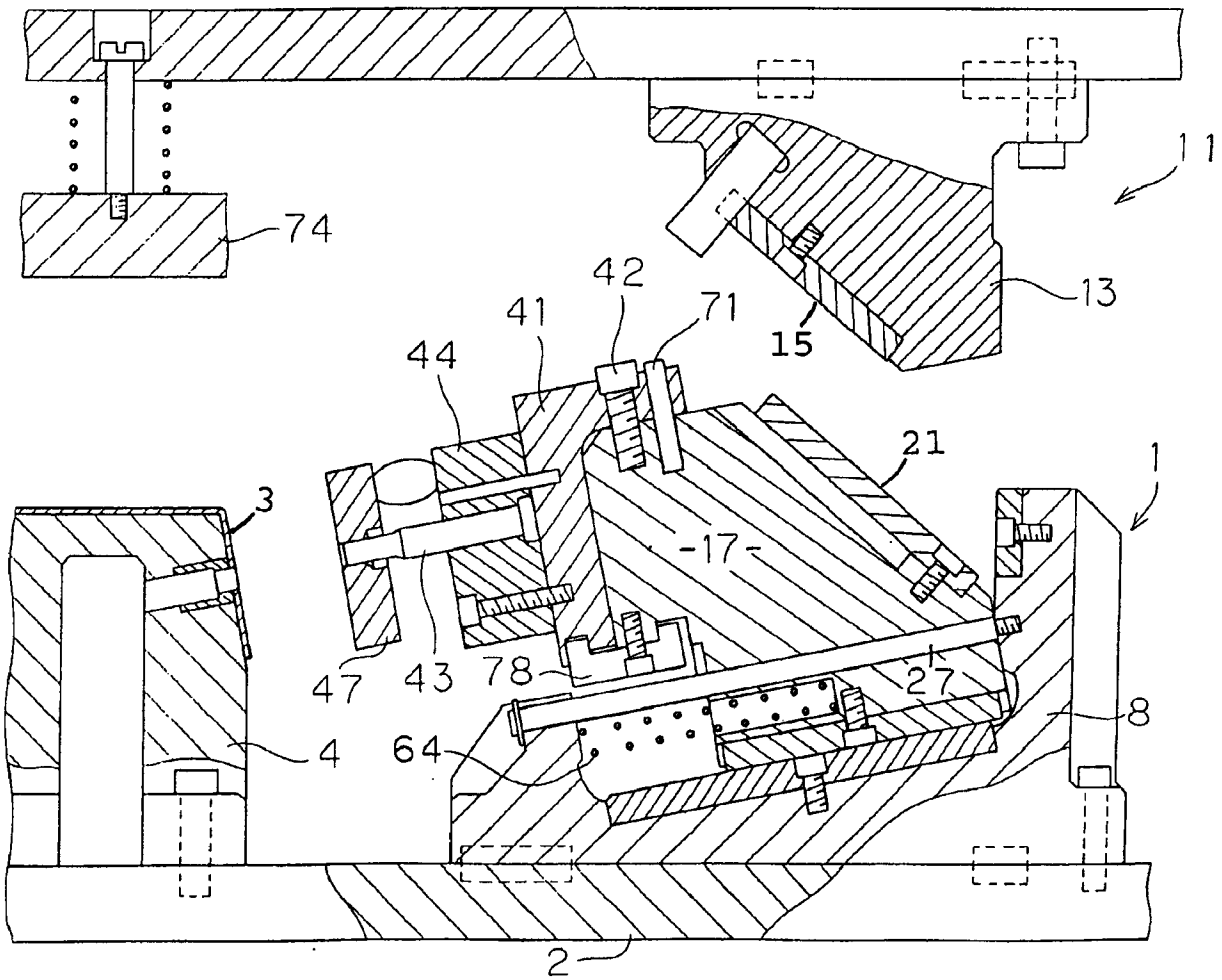
FIG. 9 is a longitudinal sectional view at the upper dead point of the slide cam die of the present invention.

The work 3, as shown in FIG. 9, is placed on the positioning member 4 and the upper die 11 is moved down.

When the upper die 11 fails from the state, the pad 74 presses the work piece 3, the wear plate 21 of the slide cam 17 is put into contact with the ware plate 15 of the actuating cam 13 and the slide cam 17 advances toward the work piece 3 in a space interposed between the slide cam base 8 and the actuating cam 13 with more of a fall of the upper die 11 to make a hole in the work piece 3 with the pierce punch 43.

FIG. 1 shows that a state in which a hole has been made by the pierce punch 43, and the upper die 11 is positioned at the lower dead point.

Thereafter, when the upper die II rises, a press force of the coil spring 64 is transmitted to the slide cam 17 to cause it to withdraw causing a rear end face 26 of the slide cam 17 to come into contact-with the stopper face 25, thus ceasing the movement of the slide cam 17.

Since the return plate 73 is provided to the slide cam 17, when the slide cam 17 does note retreat for some reason or other, the return plate 73 forcibly causes the slide cam 17 to retreat by engaging with the slide cam base 8.

The adapter plate 41 and the lock plate 78 will be described next.

The adapter plate 41, as shown in FIGS. 2 to 5, is constituted of an engaging piece 81 and a downwardly-hanging piece 82 to be in the shape of an L letter as a whole. The inner face of the adapter plate 41 is formed so as to facilitate positioning thereof by putting it into contact with the right angle corner at the upper front end of the slide cam 17. In the engaging piece 81, there are formed two bolt holes 83, one knock pin hole 84 and one bolt hole 85. The bolt hole 85 facilitates demounting the adapter plate 41 by screwing a bolt thereinto, to thereafter pull up if there is difficulty in demounting the adapter plate 41.

In order to correctly position it in the front-rear direction, the positioning groove 80 in the shape of an L is formed at the lower end of the dropping piece 82.

Furthermore, three reference holes 86 for correctly mounting the pierce punch 43, or the like, is formed on a mounting surface for the punch retainers 44 of the adapter plate 41.

Figure 6:
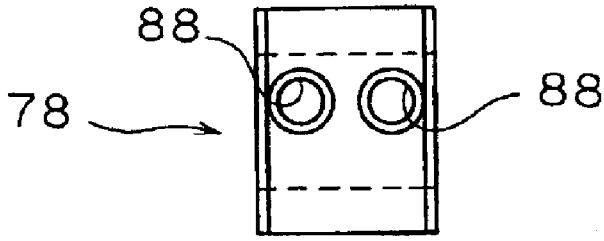
FIG. 6 is a bottom view of a lock plate of the present invention.
Figure 7:
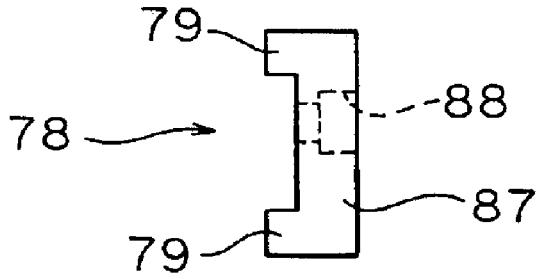
FIG. 7 is a side view of the lock plate of the present invention.
Figure 8:
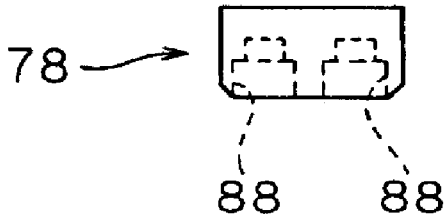
FIG. 8 is a front view of the lock plate of the present invention.

Although the adapter plate 41 is of a sectional shape of an L, it can be one piece type or a split type. On the lock plate 78, as shown in FIGS. 6 to 8, the protruding pieces 79 extend from both sides of a base piece 87 and two bolt holes 88 are formed in the base piece 87.

As shown in FIG. 9, when taking out the pierce punch 43 due to a chipping-off of blade edge thereof or the like, if a sufficient working space exists above the adapter plate 41 while the upper die 11 is at the position of the upper dead point, the bolt 42 is removed, and the knock pin 71 is pulled off, the adapter plate 41 can be moved upwardly to demount. The pierce punch 43 or another tool is installed on the adapter plate 41, demounting of the pierce punch 43 is easily enabled without removing the entire slide cam 17.

For mounting the pierce punch 43, the inner face in the shape of an L of the adapter plate 41 attached to the pierce punch 43 is put into contact with the upper front end face of the slide cam 17. In addition, the protruding pieces 79 of the lock plate 78 are engaged with the adapter plate 41.

With the engagement between the adapter plate 41 and the protruding pieces 79 of the lock plate 78, positioning of the adapter plate 41 in the front to rear direction can be correctly performed. In addition, no need arises for pullingout/inserting of a knock pin for the lock plate 78 and the adapter plate 41 is simply moved from above to below while sliding to engage the positioning groove 80 with the protruding pieces 79. As shown in FIG. 1, in order to correctly position the positioning groove 80 and the protruding pieces 79 therebetween in the front to rear direction, there are intentionally provided clearances A, B, C and D between the ceiling of the positioning groove 80, the upper surfaces of the protruding pieces 79 and the like. As declared in the figures, contact faces at three sites are formed among the lock plate 78, the adapter plate 41 and the slide cam 17 in the front to rear direction and contact faces, and only one site is formed in the above to below direction.

In the above mentioned embodiment, while the example in which a corner angle of the section in the shape of an L letter of the adapter plate 41 is an right angle is described, the present invention has no specific limitation thereto, but can set to optional angle. A preferable example is a case where an angle of the corner of the section in the shape of an L letter is a right angle.

In the embodiment described above, while the example in which the actuating cam 13, the slide cam 17 and the slide cam base 8 are arranged sequentially in the order from above to below is described, an arrangement can be adopted in the reverse order, that is, in the order of the slide cam 8, the slide cam 17 and the actuating cam 13 from above to below. In this case, adapter plates may be attached to both sides of the slide cam.

Furthermore, while the embodiment describes the example of hole making, needless to say that the present invention can be applied to other processes such as bending process.

If the actuating cam 13, the slide cam 17 and the slide cam base 8 are standardized in sizes, immediate adaptation is enabled to processing of any works with various magnitude in sizes.

The present invention is a slide cam die comprising; a slide cam base; a wedge-shaped slide cam sliding on a guide surface of the slide cam base and mounting a press tool such as a punch or a trimming blade thereon; and an actuating cam driving the slide cam in contact therewith, wherein a press tool is mounted on the slide cam with an adapter plate interposing therebetween, therefore, when a pierce punch, a flange block or the like are necessary to be demounted for reasons such as adjustment, the pierce punch, the flange block or the like is slightly demounted without taking out a slide cam as a whole to thereby reduce a working time, in addition, only an adapter plate is replaced to thereby enable the reuse of a slide cam and attain cost reduction, furthermore, a given slide cam is used to increase flexibility in design aspect to a great degree.

Moreover, the present invention, to be concrete, has a feature that a lock plate is mounted on the slide cam to engage with an end of the adapter plate to position the adapter plate correctly.

Furthermore, the present invention, to be concrete, has a feature that the adapter plate is formed so as to have a section of an L letter shape and positioned by putting an inner face thereof into contact with the slide cam.

Still furthermore, the present invention, to be concrete, has a feature that the slide cam is a lower die.

Yet furthermore, the present invention, to be concrete, has a feature that the slide cam is an upper die.

What is claimed is:

1. A slide cam die comprising:

a slide cam base, a wedge-shaped slide cam with a press tool mounted thereon, the wedge-shaped slide cam sliding on a guide surface of the slide cam base;

an actuating cam making contact with and driving the wedge-shaped slide cam; and an L-shaped adapter plate interposed between the press tool and the slide cam, the L-shaped adapter plate being positioned by putting side and upper inner faces thereof into contact with side and upper surfaces of the wedged-shaped slide cam.

2. The slide cam die according to claim 1, further comprising a lock plate mounted on an underside of the slide cam to engage with an end of a downwardly-hanging piece of the L-shaped adapter plate, thus correctly positioning the L-shape adapter plate onto the wedged-shaped slide cam.

3. The slide cam die according to claim 2, wherein the lock plate includes a base piece, with protruding pieces extending from one side of the base piece, and two bolt holes are formed on an opposite side of the base piece.

4. The slide cam die according to claim 3, wherein the protruding pieces are inserted into a positioning groove of the downwardly-hanging piece of the L-shaped adapter plate and a positioning groove of the underside of the slide cam, thus fixing the L-shaped adapter plate to the wedge-shaped slide cam.

5. The slide cam die according to claim 4, wherein multiple clearances are provided between sides of the protruding pieces and inner walls of the positioning groove of the L-shaped adapter plate and the inner walls of the positioning groove of the wedge-shaped slide cam.

6. The slide cam die according to claim 1, wherein the L-shaped adapter plate is constituted of an engaging piece facing the upper surface of the wedged-shaped slide cam and a downwardly-hanging piece facing the side surface of the wedge-shaped slide cam, a knock pin hole and a bolt hole being formed in the engaging piece, the bolt hole for screwing a bolt thereinto, and thereafter pulling the bolt when there is difficulty in demounting the L-shaped adapter plate.

7. The slide cam die according to claim 1, wherein said slide cam is a lower die.

8. The slide cam die according to claim 1, wherein said slide cam is a upper die.

9. The slide cam die according to claim 1, wherein the press tool is a punch or a trim blade.

10. A slide cam die comprising:

an upper die vertically movable with respect to a lower die, the lower die having a slide cam base;

a wedge-shaped slide cam with a press tool mounted thereon, the wedge-shaped slide cam sliding on a guide surface of the slide cam base;

an actuating cam fixed to the upper die for driving the wedge-shaped slide cam; and an L-shaped adapter plate interposed between the press tool and the slide cam, the L-shaped adapter plate being positioned by putting side and upper inner faces thereof into contact with side and upper surfaces of the wedged-shaped slide cam.

11. The slide cam die according to claim 10, further comprising a lock plate mounted an underside of on the slide cam to engage with an end of a downwardly-hanging piece of the L-shaped adapter plate, thus correctly positioning the L-shaped adapter plate onto the wedged-shaped slide cam.

12. The slide cam die according to claim 11, wherein the lock plate includes a base piece, with protruding pieces extending from one side of the base piece, and two bolt holes are formed on an opposite side of the base piece.

13. The slide cam die according to claim 12, wherein the protruding pieces are inserted into a positioning groove of the downwardly-hanging piece of the L-shaped adapter plate and a positioning groove of the underside of the slide cam, thus fixing the L-shaped adapter plate to the wedge-shaped slide cam.

14. The slide cam die according to claim 13, wherein multiple clearances are provided between sides of the protruding pieces and inner walls of the positioning groove of the adapter plate and the inner walls of the positioning groove of the wedge-shaped slide cam.

15. The slide cam die according to claim 10, wherein the adapter plate is constituted of an engaging piece facing the side surface of the wedged-shaped slide cam and a downwardly-hanging piece facing the side surface of the wedged-shaped slide cam, a knock pin hole and a first bolt hole and a second bolt hole being formed in the engaging piece, the first bolt hole for screwing a first bolt thereinto, and thereafter pulling up the first bolt when there is difficulty in demounting the adapter plate.

16. The slide cam die according to claim 15, further comprising a second bolt that passes through the second bolt hole of the engaging piece and screws into the wedge-shaped slide cam.

17. The slide cam die according to claim 10, further comprising a punch retainer positioned with respect to a downwardly-hanging piece of the L-shaped adapter plate by a knock pin and screwed to a hanging down-piece of the L-shaped adapter plate by a bolt, wherein the press tool is inserted into the punch retainer.

18. The slide cam die according to claim 10, wherein the press tool is a punch or a trim blade.

19. A slide cam die comprising:

an upper die vertically movable with respect to a lower die, the lower die having a slide cam base;

a wedge-shaped slide cam with a press tool mounted thereon, the wedge-shaped slide cam sliding on a guide surface of the slide cam base;

an actuating cam fixed to the upper die for driving the wedge-shaped slide cam;

an adapter plate having a downwardly-hanging piece interposed between the press tool and the slide cam; a lock plate having two protruding pieces projecting into an underside of the slide cam to engage with a lower most portion of the downwardly-hanging piece of the adapter plate, thus correctly positioning the adapter plate onto the wedged-shaped slide cam, wherein clearances are provided above the two protruding pieces of the lock plate.

* * * * *